US009005522B2

(12) United States Patent
Bridgeman

(10) Patent No.: US 9,005,522 B2
(45) Date of Patent: Apr. 14, 2015

(54) SILVER ALLOY

(71) Applicant: Jostens, Inc., Minneapolis, MN (US)

(72) Inventor: Todd Cleabert Bridgeman, Owatonna, MN (US)

(73) Assignee: Jostens, Inc., Minneapolis, MN (US)

( * ) Notice: Subject to any disclaimer, the term of this patent is extended or adjusted under 35 U.S.C. 154(b) by 0 days.

(21) Appl. No.: 13/668,980

(22) Filed: Nov. 5, 2012

(65) Prior Publication Data

US 2014/0065011 A1 Mar. 6, 2014

Related U.S. Application Data

(60) Provisional application No. 61/694,836, filed on Aug. 30, 2012.

(51) Int. Cl.

| | |
|---|---|
| ***C22C 5/06*** | (2006.01) |
| ***C22C 5/08*** | (2006.01) |
| ***C22F 1/14*** | (2006.01) |

(52) U.S. Cl.

CPC ... *C22C 5/06* (2013.01); *C22C 5/08* (2013.01); *C22F 1/14* (2013.01)

(58) Field of Classification Search

CPC ..... C22C 5/00; C22C 5/06; C22C 5/08
USPC ..... 148/430, 431; 420/501–506
See application file for complete search history.

(56) References Cited

U.S. PATENT DOCUMENTS

| | | | |
|---|---|---|---|
| 2,259,668 | A | 10/1941 | Jakob |
| 3,925,073 | A | 12/1975 | Kohrn et al. |
| 4,247,602 | A | 1/1981 | Krug et al. |
| 4,264,359 | A | 4/1981 | Harris et al. |
| 4,446,102 | A | 5/1984 | Bales |
| 4,804,517 | A | 2/1989 | Schaffer et al. |
| 4,973,446 | A | 11/1990 | Bernhard et al. |
| 4,992,297 | A | 2/1991 | van der Zel |
| 5,037,708 | A | 8/1991 | Davitz |
| 5,045,411 | A | 9/1991 | Taylor et al. |
| 5,552,225 | A | 9/1996 | Ho |
| 5,558,833 | A | 9/1996 | Zamojski |
| 5,599,406 | A | 2/1997 | Prasad et al. |
| 5,882,441 | A | 3/1999 | Davitz |
| 6,139,652 | A | 10/2000 | Carrano et al. |
| 6,260,383 | B1 | 7/2001 | Warren et al. |

(Continued)

FOREIGN PATENT DOCUMENTS

| | | |
|---|---|---|
| CN | 101218361 | 7/2008 |
| EP | 1065288 | 1/2001 |

(Continued)

OTHER PUBLICATIONS

"The Essential Guide to the U.S. Trade in Gold and Silver Jewelry", Jewelers Vigilance Committee, New York, New York, 2008, 10 pages.

(Continued)

*Primary Examiner* — Scott Kastler
*Assistant Examiner* — Vanessa Luk
(74) *Attorney, Agent, or Firm* — Winthrop & Weinstine, P.A.

(57) ABSTRACT

A platinum-free silver alloy may include about 0.1% to 0.9% Au, about 83% to 90% Ag, about 2% to 3% Pd, about 3% to 5% Zn, about 2% to 8% Cu, about 0.01% to 0.4% B, about 0.1% to 0.3% Ge, and about 0.01% to 0.03% Ir.

13 Claims, 1 Drawing Sheet

(56) References Cited

U.S. PATENT DOCUMENTS

| | | | | |
|---|---|---|---|---|
| 6,406,664 | B1 | 6/2002 | Diamond | |
| 6,726,877 | B1 | 4/2004 | Eccles | |
| 6,841,012 | B2 | 1/2005 | Croce | |
| 7,128,871 | B2 | 10/2006 | Davitz | |
| 7,258,689 | B2 | 8/2007 | Salvo | |
| 7,354,471 | B2 | 4/2008 | Hampden-Smith et al. | |
| 2003/0012679 | A1 | 1/2003 | Poliero et al. | |
| 2006/0144476 | A1 | 7/2006 | Eccles | |
| 2007/0181224 | A1 | 8/2007 | Marya et al. | |
| 2008/0069722 | A1* | 3/2008 | Johns | 420/504 |
| 2009/0185945 | A1 | 7/2009 | Thielemann | |
| 2010/0047618 | A1 | 2/2010 | Rostagno | |
| 2010/0193088 | A1 | 8/2010 | Chen et al. | |
| 2010/0209287 | A1 | 8/2010 | Bennett | |

FOREIGN PATENT DOCUMENTS

| | | |
|---|---|---|
| GB | 508669 | 7/1939 |
| GB | 2426250 | 11/2006 |
| GB | 2438198 | 11/2007 |
| JP | 57152437 | 9/1982 |
| JP | 2000079008 | 3/2000 |
| JP | 2001040438 | 2/2001 |
| WO | 2004087996 | 10/2004 |
| WO | 2008067815 | 6/2008 |

OTHER PUBLICATIONS

Mozgovoy et al. "Investigation of mechanical, corrosion and optical properties of an 18 carat Au—Cu—Si—Ag—Pd bulk metallic glass", Intermetallics, Dec. 18, 2010, pp. 2289-2291.

Ntukogu et al. "Effect of Palladium on the Tarnishing of Cu—Ag—Au Alloys", Journal of the Less Common Metals, vol. 125, Nov. 1986, pp. 197-205.

Mills, A.F. et al. "Error Analysis of Experiments: A Manual for Engineering Students", University of California, 2004, pp. 1-49.

* cited by examiner

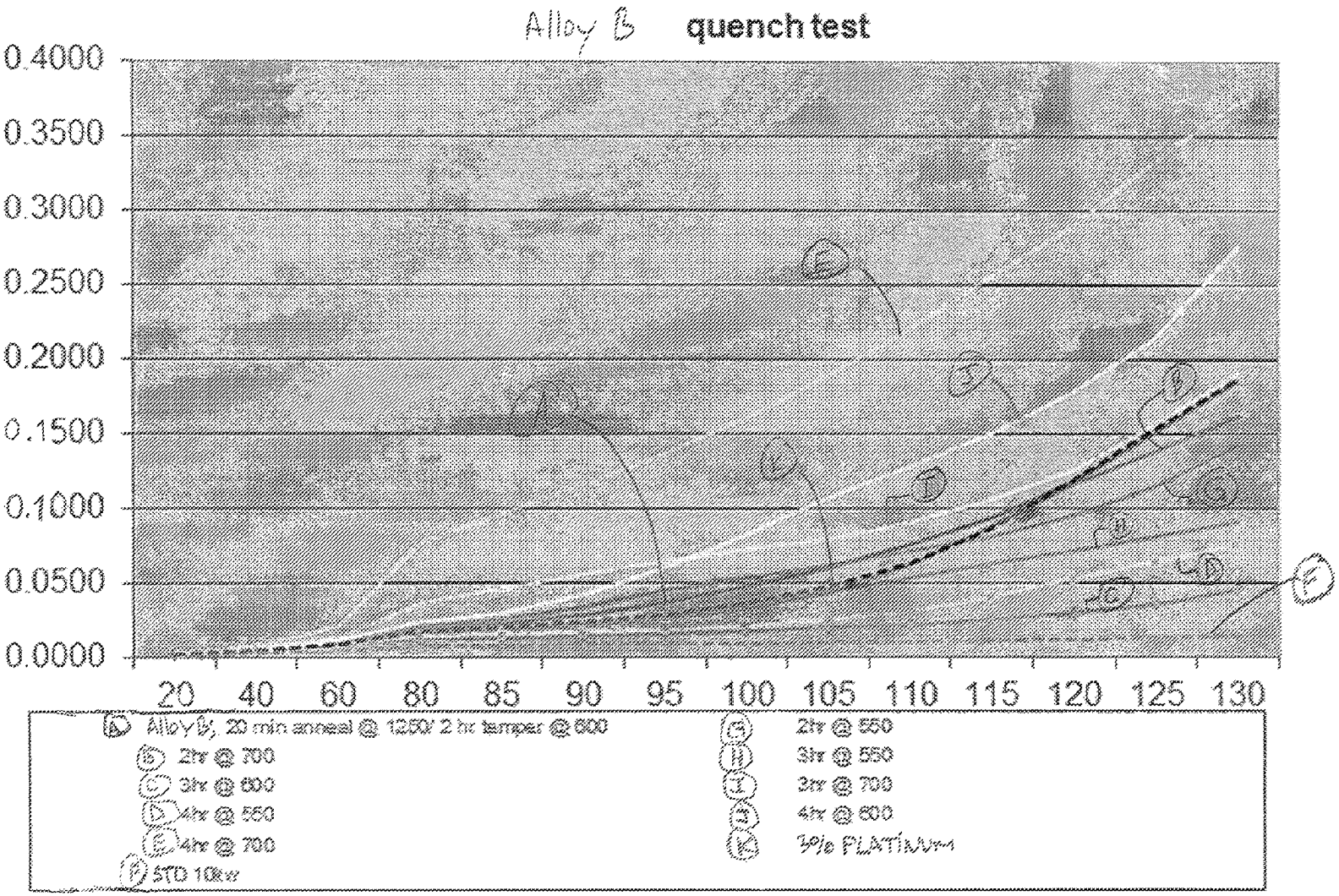
Alloy B quench test
0.4000
0.3500
0.3000
0.2500
0.2000
0.1500
0.1000
0.0500
0.0000
20
40
60
80
85
90
95
100
105
110
115
120
125
130
Alloy B, 20 min anneal @ 1250 2 hr temper @ 600
2hr @ 700
3hr @ 600
3hr @ 550
4hr @ 550
4hr @ 700
STD 10kW
2hr @ 550
3hr @ 550
3hr @ 700
4hr @ 600
% PLATINUM

SILVER ALLOY

CROSS REFERENCE TO RELATED APPLICATION

The present application claims priority to U.S. Provisional Application No. 61/694,836 filed on Aug. 30, 2012 entitled "SILVER ALLOY", the contents of which are hereby incorporated by reference herein in their entirety.

FIELD OF THE INVENTION

The present application relates to metal alloys. More particularly, the present application relates to metal alloys that are white in color. Still more particularly, the present disclosure relates to silver alloys that are relatively hard and have relatively high tarnish resistance and have a reduced platinum content.

BACKGROUND

Several silver alloys are used for manufacturing rings and other articles of jewelry. Commonly, these alloys contain from 2-15% platinum, for example. These alloys are desirable for their properties such as color, tarnish resistance, corrosion resistance, workability, and castability.

The cost of platinum continues to increase and, as such, it may be desirable to develop an alloy having similar properties and characteristics as the above-mentioned alloys, but with lower or even substantially zero platinum content. However, reducing the platinum content can lead to issues of reduced hardness, reduced tarnish resistance, and other drawbacks associated with reduced amounts of platinum.

SUMMARY

In one embodiments, a substantially platinum-free silver alloy exhibiting the appearance and properties of a platinum silver alloy is provided. The alloy may include, expressed by weight, about 0.1-0.9% Au, about 83-90% Ag, about 2-3% Pd, about 3-5% Zn, about 2-8% Cu, about 0.01-0.4% B, about 0.1-0.3% Ge, and about 0.01-0.03% Ir. In some embodiments, the above alloy may include, expressed by weight, about 0.5% Au, about 85% Ag, about 2.5% Pd, about 4% Zn, about 7% Cu, about 0.25% B, about 0.2 Ge, and about 0.02% Ir. In still other embodiments, the platinum-free silver alloy may include, expressed by weight, about 0.5% Au, about 88% Ag, about 2.5% Pd, about 4% Zn, about 4.3% Cu, about 0.04% B, about 0.2% Ge, and about 0.02% Ir.

While multiple embodiments are disclosed, still other embodiments of the present invention will become apparent to those skilled in the art from the following detailed description. As will be apparent, the invention is capable of modifications in various obvious aspects, all without departing from the spirit and scope of the present invention. Accordingly, the detailed description is to be regarded as illustrative in nature and not restrictive.

BRIEF DESCRIPTION OF THE FIGURES

FIG. 1 is a graph of deflection test results for an alloy, according to some embodiments.

DETAILED DESCRIPTION

The present application, in some embodiments, is directed toward silver alloys with reduced or substantially eliminated platinum content that exhibit similar or better properties and characteristics compared to alloys containing platinum. For example, former silver alloys may have contained up to 10% or more platinum. As costs increased, efforts to reduce the platinum content resulted in alloys including, for example, about 77% Ag, about 3% Pt, about 16% Cu, about 3.5% Zn, about 0.005% B, and about 0.2% Ge. The present application, in some embodiments, and in contrast to the current alloy includes substantially no platinum, includes some gold, some palladium, an increased amount of silver, and a reduced amount of copper. The reduced platinum content makes the disclosed alloy much more cost effective. Still further, the substitution of Palladium, another Platinum Group Metal (PGM), for the Platinum allows for an alloy that performs dramatically better in cast and throughout production. Moreover, the addition of Gold increased the cast performance while also improving the resistance to tarnishing. In addition, the reduced Copper content, when compared to the above listed 3% Platinum example, appears to contribute to the improved tarnish resistance. Moreover, the addition of a small amount of Iridium has been found to help the overall grain structure and, as such, is a good grain modifier. When adjusting the amount of Boron to use, it was found that reducing the amount of Boron allowed for good nucleation points and the alloy was heat treatable. Too much Boron, on the other hand, had adverse effects. Moreover, the combination of the selected Silver and Copper content together with the heat treatability provides for a harder material.

In one embodiment, a silver alloy may be provided with substantially no platinum. In this embodiment, the alloy may include, gold (Au), silver (Ag), palladium (Pd), zinc (Zn), Copper (Cu), Boron (B), Germanium (Ge), and Iridium (Ir). It is noted that while the amounts of each of these elements described below may be listed in isolation, some of the elements may be provided in compound form. For example, Cu may be provided in compound form with one or each of B, Ge, and Ir. Still other elements of the alloy may also be provided in compound form.

The above-mentioned embodiment may include, expressed by weight, about 0.1% to about 2.5% or 3% Au. In other embodiments, the alloy may include, expressed by weight, about 0.4% to about 0.6% or 1.0% Au, or the alloy may include about 0.5% Au. Other amounts of Au within or beyond the described ranges may also be provided.

The present alloy may also include, expressed by weight, about 83% to about 95% Ag. In other embodiments, the alloy may include, expressed by weight, about 84% to about 89% Ag, or the alloy may include about 85% Ag or about 88% Ag. Other amounts of Ag within or beyond the described ranges may also be provided.

The present alloy may also include, expressed by weight, about 2% to about 5% Pd. In other embodiments, the present alloy may include, expressed by weight, about 2.25% to about 2.75% Pd, or about 2.5% Pd may be provided. Other amounts of Pd within or beyond the described range may also be provided.

The present alloy may also include, expressed by weight, about 3% to about 5% Zn. In other embodiments, the present alloy may include, expressed by weight, about 3.5% to about 4.5% Zn, or about 4% Zn may be provided. Other amounts of Zn within or beyond the described range may also be provided.

The present alloy may also include, expressed by weight, about 2% to about 8% Cu. In other embodiments, the present alloy may include, expressed by weight, about 4% to about 7.5% Cu, or about 4.3% Cu or about 7% Cu, may be provided. Other amounts of Cu within or beyond the described range may also be provided.

The present alloy may also include, expressed by weight, about 0.005% to about 0.4% B. In other embodiments, the present alloy may include, expressed by weight, about 0.01% to about 0.35% B or about 0.04% B or about 0.25% B may be provided. Other amounts of B within or beyond the described ranges may also be provided.

The present alloy may also include, expressed by weight, about 0.1% to about 0.3% Ge. In other embodiments, the present alloy may include, expressed by weight, about 0.15% to about 0.25% Ge or about 0.2% Ge may be provided. Other amounts of Ge within or beyond the described range may also be provided.

The present alloy may also include, expressed by weight, about 0.01% to about 0.03% Ir. In other embodiments, the present alloy may include, expressed by weight, about 0.015% to about 0.025% Ir or about 0.02% Ir may be provided. Other amounts of Ir within or beyond the described range may also be provided.

The Ge and Ir elements of the present alloy may be referred to as grain modifiers. In some embodiments, other elements near or around these two elements in the periodic table may also be used. For example, in some embodiments, Gallium (Ga) or Indium (In) may be substituted for Ge. In still other embodiments, Osmium (Os) or Rhenium (Re) may be substituted for Ir. Other combinations of these elements may also be provided and, as such, several combinations of these grain modifier elements may be used together with the other elements of the alloy discussed above.

In some embodiments, the alloy may be heat treated. The heat treating may include annealing from 30 minutes to 3 hours at a temperature ranging from about 1110 degrees Fahrenheit to about 1300 degrees Fahrenheit and tempering for 1 hour to 3 hours at a temperature ranging from about 550 degrees Fahrenheit to approximately 700 degrees Fahrenheit. In some embodiments, heat treating may include annealing for one hour at 1250 degrees Fahrenheit and tempering for two hours at 625 degrees Fahrenheit.

In one tested example, a silver alloy (Alloy A) included 0.5% Au, 85.34% Ag, 2.5% Pd, 4% Zn, 7.18% Cu, 0.26% B, 0.02% Ir, and 0.2% Ge. Vickers hardness values on a first sample that was quenched for 30 minutes, annealed at 1250 degrees Fahrenheit for 20 minutes and tempered for two hours at 600 degrees Fahrenheit exhibited the following Vickers hardness values ($HV_{500}$): 154, 157, 145, 158, and 154 with an average of 154. On a second sample that was quenched for 30 minutes and tempered for two hours at 400 degrees Fahrenheit Vickers hardness values ($HV_{500}$) were 89, 85, 89, 95, and 93 with an average of 90. On still another sample that was quenched for 30 minutes, Vickers hardness values were 82, 80, 81, 88, and 85 with an average of 83.

In another tested example, a silver alloy (Alloy B) included 0.5% Au, 88.4% Ag, 2.5% Pd, 4% Zn, 4.3% Cu, 0.04% B, 0.02% Ir, and 0.2% Ge. Vickers hardness values on a sample exhibited the following Vickers hardness values ($HV_{500}$): 135, 131, 140, 129, and 133 with an average of 134.

In some respects, deflection testing may be indicative of hardness. With reference to FIG. 1, results of deflection testing of Alloy B are shown. The several lines on the graph reflect differing heat treatments in addition to comparison lines for STD 10 kw and the above mentioned 3% platinum alloy discussed at the beginning of the detailed description.

As can be seen from the above hardness and deflection testing results, the alloys described herein may result in substantially hard materials that fare quite well when used as jewelry alloys. That is, the alloys may resist nicks, scratches, deformations such as out-of-round deformation, and other wear and tear quite well. As suggested by FIG. 1, in some embodiments, the alloys may be harder than the 3% platinum material described at the beginning of the detailed description.

Chemical testing was also conducted on the above two alloys and compared to the 3% platinum alloy discussed at the beginning of the detailed description. The three alloys each included the following nominal copper content by weight:

a. 3% Platinum Alloy 14.1% Cu;
b. Alloy A 7.2% Cu; and
c. Alloy B 4.3% Cu.

The silver-copper interdentritic phase volume percentage was measured for each alloy resulting in the following. The measurements for the 3% platinum alloy included 13.5, 17.3, 16.6, 15.5, and 19.1 for an average of 16.4. The measurements for Alloy A included 5.7, 5.4, 5.2, 5.6, and 5.3 for an average of 5.4. The measurements for Alloy B included 2.6, 1.9, 2.3, 1.4, and 1.8 for an average of 2.0. As such, Alloys A and B showed a surprising resistance to discoloration and performed much better than the platinum alloy.

The alloys discussed herein may be manufactured by standard procedures in the manufacture of precious metal alloys. The alloys may be manufactured by weighing out selected amounts of the elements or compounds thereof. The elements and/or compounds may be combined and heated in a suitable container such as a crucible. In some embodiments, the melt may be stirred.

Accordingly, the present application may relate to a method for manufacturing silver alloys as defined above, which includes casting the constituent elements of the alloy either in the pure state or in the alloy state, under an inert atmosphere. The present disclosure may further relate to the use of the alloys defined above for the manufacture of jewelry or other items by investment casting, such as a lost wax process. In still other embodiments, the present application may related to a cast object comprising the presently disclosed alloy or alloys.

Although the invention has been described with reference to various embodiments, persons skilled in the art will recognize that changes may be made in form and detail without departing from the spirit and scope of the invention.

The invention claimed is:

1. A platinum-free silver alloy consisting of:
about 0.1% to 0.9% Au by weight;
about 83% to 90% Ag by weight;
about 2% to 3% Pd by weight;
about 3% to 5% Zn by weight;
about 2% to 8% Cu by weight;
about 0.01% to 0.4% B by weight; and
a grain modifier consisting of one of Ge, Ga, and In and one of Ir, Os, and Re.

2. The alloy of claim 1, wherein the grain modifier is about 0.1% to 0.3% Ge, by weight, and about 0.01% to 0.03% Ir by weight.

3. The alloy of claim 1, consisting of about 0.5% Au by weight.

4. The alloy of claim 1, consisting of about 85% Ag by weight.

5. The alloy of claim 1, consisting of about 88% Ag by weight.

6. The alloy of claim 1, consisting of about 2.5% Pd by weight.

7. The alloy of claim 1, consisting of about 4% Zn by weight.

8. The alloy of claim 1, consisting of about 4.3% Cu by weight.

9. The alloy of claim 1, consisting of about 7% Cu by weight.

10. The alloy of claim 1, consisting of about 0.04% B by weight.

11. The alloy of claim 1, consisting of about 0.25% B by weight.

12. The alloy of claim 1, consisting of about 0.2% Ge by weight.

13. The alloy of claim 1, consisting of about 0.02 Ir by weight.

* * * * *